US006889884B2

(12) United States Patent
Jakob et al.

(10) Patent No.: US 6,889,884 B2
(45) Date of Patent: May 10, 2005

(54) SETTING TOOL

(75) Inventors: Robert Jakob, Feldkirch (AT); Norbert Welte, Klaus (AT)

(73) Assignee: Hilti Aktiengesellschaft, Schaan (LI)

( * ) Notice: Subject to any disclaimer, the term of this patent is extended or adjusted under 35 U.S.C. 154(b) by 30 days.

(21) Appl. No.: 10/059,842

(22) Filed: Jan. 29, 2002

(65) Prior Publication Data

US 2002/0100788 A1 Aug. 1, 2002

(30) Foreign Application Priority Data

Jan. 30, 2001 (DE) ..... 101 03 893

(51) Int. Cl.[7] ..... B25C 1/14
(52) U.S. Cl. ..... 227/10
(58) Field of Search ..... 227/9–11, 130; 173/132, 210

(56) References Cited

U.S. PATENT DOCUMENTS 3,115,636 A * 12/1963 Elliot ..... 227/10
3,115,637 A * 12/1963 Elliot ..... 227/10
3,129,429 A * 4/1964 Hilti ..... 227/10
3,249,279 A * 5/1966 Behrend et al. ..... 227/10
3,273,469 A 9/1966 Doyle
3,399,817 A * 9/1968 Diehl ..... 227/10
3,465,942 A * 9/1969 Diehl ..... 227/10
3,566,978 A * 3/1971 Udert ..... 173/211
3,820,266 A * 6/1974 Larsson ..... 42/25
3,915,242 A * 10/1975 Bell ..... 173/206
4,074,845 A * 2/1978 Combette et al. ..... 227/10
4,174,113 A * 11/1979 Eckman ..... 279/19.4
4,189,081 A 2/1980 Combett et al.
4,332,340 A 6/1982 Harris
5,896,934 A * 4/1999 Yaniero et al. ..... 173/132
5,950,900 A * 9/1999 Frommelt et al. ..... 227/9
6,098,723 A * 8/2000 Yaniero et al. ..... 173/128
6,220,495 B1 * 4/2001 Jakob ..... 227/10
6,289,789 B1 * 9/2001 Heeb et al. ..... 92/169.1

* cited by examiner

*Primary Examiner*—Stephen F. Gerrity
(74) *Attorney, Agent, or Firm*—Sidley Austin Brown & Wood, LLP

(57) ABSTRACT

A setting tool including a piston guide (1) for guiding the drive piston (4) of the tool, a bolt guide (2), and a buffer member (8) located in the guide bore (12) of the piston guide (1) between the sealing element (5) of the drive piston (4) and the bolt guide (2) and surrounding the drive piston stem (6), with the guide bore (12) of the piston guide (1) having at least one stop shoulder (7) having a stop surface facing in the setting direction, and the buffer member (8) having at least one mating shoulder (10) having a facing in a direction opposite the setting direction, mating surface cooperating with the stop surface of the stop shoulder (7) of the guide bore (12).

8 Claims, 1 Drawing Sheet

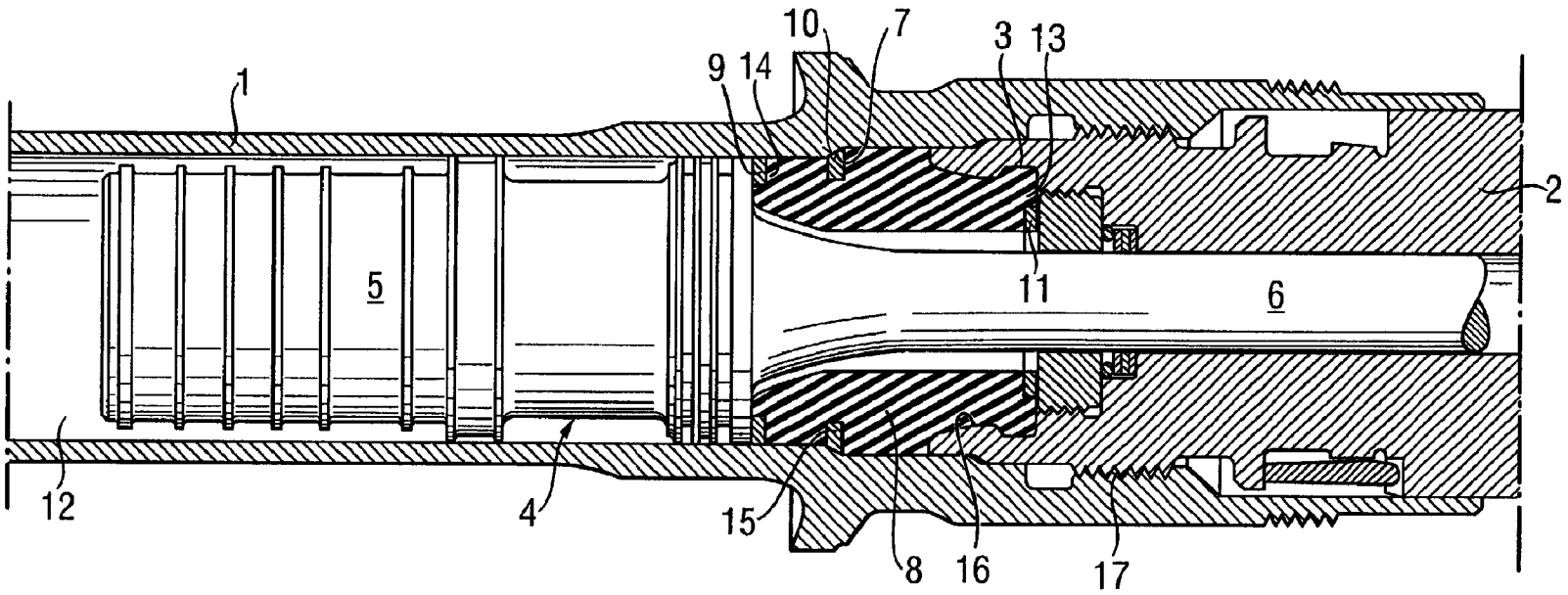
2
6
17
13
11
3
16
7
8
10
14
9
15
4
5
1
12

SETTING TOOL

BACKGROUND OF THE INVENTION

1. Field of the Invention

The present invention relates to a setting tool including an axially displaceable drive piston having a sealing element and a stem, a piston guide for guiding the drive piston, a bolt guide adjoining the piston guide at a setting direction side of the piston guide, and a buffer member located in a guide bore of the piston guide between the sealing element of the drive piston and the bolt guide and surrounding the drive piston stem.

2. Description of the Prior Art

In setting tools, the buffer member is designed for absorbing an excess kinetic energy of the drive piston. By absorbing the excess kinetic energy, the buffer member prevents the drive piston and components which surround the drive piston of the setting tool from being damaged. A buffer member of the type described above is disclosed, e.g., in U.S. Pat. No. 3,249,279. The buffer member, which is disclosed in the patent, is located in the piston guide between the sealing element of the drive piston and the bolt guide. The buffer member is formed as a sleeve-shaped part surrounding the stem of the drive piston. The buffer member is directly impacted by the drive piston and is compressed to a greater or lesser degree dependent on the motion energy of the drive piston. During change of the tooling of the setting tool or during servicing of the setting tool, the buffer member can easily be lost. Because the setting operation can be conducted even without the buffer member, its absence will only then be noticed when the tool itself or its tooling becomes damaged because of an improper operation resulting from an excess motion energy of the drive piston, which should have been absorbed by the buffer member.

An object of the present invention is to provide a setting tool including a buffer member arranged in the piston guide bore between the drive piston and the bolt guide and which can be displaced, to a limited extent, parallel to the setting direction substantially wear-free.

Another object of the present invention is to provide a setting tool including a buffer member which is arranged as discussed above and has a good side support along the outer contour of the buffer member.

A further object of the present invention is to provide a setting tool including a buffer member arranged between the drive piston and the bolt guide without a possibility of being lost.

SUMMARY OF THE INVENTION

These and other objectives of the present invention, which will become apparent hereinafter, are achieved by providing in the guide bore of the piston guide at least one stop shoulder having a stop surface facing in the setting direction, and by providing the buffer member with at least one mating shoulder having a facing in a direction opposite the setting direction, mating surface cooperating with the stop surface of the stop shoulder of the guide bore.

The stop shoulder, which is provided in the guide bore of the piston guide, and the mating shoulder, which is formed on the buffer member, cooperate to limit the displacement of the buffer member in a direction parallel to the setting direction.

For manufacturing reasons, the stop shoulder in the piston guide is formed by a widening section of the guide bore.

When several stop shoulders are provided, each widening section can be formed, e.g., by an elongate groove or slot extending in the wall of the guide bore. When the widening section is formed by an elongate slot, the slot can extend, in the radial direction, through the entire thickness of the bore wall.

In order for a force, which is generated by a rebound of the buffer member from a compressed end position into its release initial position, to be evenly distributed over the circumference of the buffer member for transmission to the stop shoulder in the piston guide, advantageously, the mating shoulder of the buffer member is formed by a radial widening of the buffer member and which extends at least partially over the circumference of the buffer member.

In order to prevent substantial wear of the mating shoulder of the buffer member, the mating shoulder is formed by a radially resilient stop ring connected with the butter member and forming a portion of the radial widening of the buffer member. The stop ring is formed of a material having a greater rigidity than a material the buffer member is formed of.

The stop ring, which can be formed, e.g., of metal, extends partially into a circumferential groove formed in the buffer member. However, the stop ring can be directly connected with the buffer member with glue or by vulcanization.

In order to prevent the buffer member from being lost, e.g., during servicing of the setting tool, preferably, the setting direction-side end region of the buffer member is releasably connected with the bolt guide. The buffer member can, e.g., be glued to the bolt guide or be vulcanized thereon.

Advantageously, the setting direction-side end region of the buffer member extends into a receiving region of the bolt guide and formlockingly engages there in an undercut provided in the receiving region. This formlocking connection can be formed as a snap-in connection that prevents an inadvertent loss of the buffer member, i.e., its disengagement from the bolt guide, in particular, during changing of tooling or servicing of the setting tool. For retaining the snap-in connection, only a small holding force is required. The snap-in connection can also be formed by using a catch ring that would be partially located in the buffer member. The snap ring can be formed, e.g., by a circlip having in its circumferential region of its central bore a plurality of segment-like, radially resilient tongues.

In order to reduce the wear of the buffer member in the circumferential region of the outer contour of the end surface of the buffer member facing in a direction opposite the setting direction and in the circumferential region of the inner contour of the end surface of the buffer member facing in the setting direction, advantageously, a sealing ring is provided at each of the end surfaces. Preferably, the sealing ring, which is arranged at the facing in the direction opposite setting direction, end surface of the buffer member, is provided in the radially outer region of this end surface. The sealing ring, which is arranged at the facing in the setting direction end surface, is preferably provided in the radially inner region of this end surface.

The novel features of the present invention, which are considered as characteristic for the invention, are set forth in the appended claims. The invention itself, however, both as to its construction and its mode of operation, together with additional advantages and objects thereof, will be best understood from the following detailed description of a preferred embodiment, when read with reference to the accompanying drawings.

BRIEF DESCRIPTION OF THE DRAWINGS

In the Drawings:

Single FIGURE shows a cross-sectional view of a portion of a setting tool according to the present invention.

DETAILED DESCRIPTION OF THE PREFERRED EMBODIMENT

A setting tool according to the invention, of which only several elements are shown in the drawing, includes a piston guide 1 for guiding a drive piston 4, a bolt guide 2, and a buffer member 8 arranged between the drive piston 4 and the bolt guide 2. The bolt guide 2 projects with its end facing in a direction opposite the setting direction into a setting direction-side end region of the piston guide 1. A threaded connection 17 fixedly connects the bolt guide 2 with the piston guide 1. The drive piston 4 is formed of a sealing element 5 and a stem 6 that adjoins the sealing element 5 at its end facing in the setting direction. The sealing element 5 is located in a guide bore 12 of the piston guide 1, and the stem 6 extends through the central bore of the bolt guide 2 which also contributes to guidance of the drive piston 4.

The buffer member 8, which is formed, e.g., of an elastic material, such as rubber, is arranged between the bolt guide 2 and the sealing element 5 of the drive piston 4. The buffer member 8 partially extends, in the setting direction, into a receiving region 16 of the bolt guide 2, engaging with its free end region 13 an undercut 3 formed in the receiving region 16. Between the setting direction-side end region 13 and an opposite free end region 14 of the buffer member 8, the guide bore 12 of the piston guide 1 has a stop shoulder 7, which faces in the setting direction. The buffer member 8 has a mating shoulder 10, which is provided at a distance from the facing in the setting direction, free end region 13 of the buffer member 8 and which cooperates with the annular stop shoulder 7 of the piston guide 8. The mating shoulder 10 is formed by a radially spring-biased, stop ring 15 connected with the buffer member 8. The stop shoulder 10 forms part of a radial widening of the buffer member 8. The stop ring 15 is formed of a more rigid material than the material of the buffer member 8.

In order to prevent wear of the outer, facing in the direction opposite the setting direction, edge of the second free end region 14 of the buffer member 8 and of the inner, facing in the setting direction, edge of the central bore and which is formed on the first free end region 13, there are provided, on respective end sides of the buffer member 8, radially resilient sealing rings 9, 11, respectively. The sealing rings 9, 11 can be formed as one-disc or multi-disc sealing rings. The sealing ring 9, which is provided on the end side of the buffer member 8 facing in the direction opposite the setting direction, is arranged in a radially outer region of this end side. The sealing ring 11, which is provided on the end side of the buffer member 8 facing in the setting direction, is arranged in a radially inner region of this end side.

In case of impact and connected therewith compression of the buffer member 8 by the drive piston 4, the sealing rings 9 and 11 take over the sealing force applied to the respective edges of the buffer member 8, transmitting the sealing action to the drive piston 4 and the bolt guide 2. Thereby, the wear of the edges is prevented.

The present invention prevents wear of the outer edge of the buffer member 8 which otherwise might have resulted in a damage of the inner wall of the guide bore 12 between the bold guide 2 and the sealing element 5 that would have lead to wedging of the drive piston 4 in the piston guide 1.

Though the present invention was shown and described with references to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A setting tool, comprising an axially displaceable drive piston (4) having a sealing element (5) and a stem (6); a piston guide (1) for guiding the drive piston (4); a bolt guide (2) adjoining the piston guide (1) at a setting direction side of the piston guide (1); and a buffer member (8) located in a guide bore (12) of the piston guide (1) and extending between the sealing element (5) of the drive piston (4) and the bolt guide (2) and surrounding the drive piston stem (6), the guide bore (12) of the piston guide (1) having at least one stop shoulder (7) having a stop surface facing in a setting direction, and the buffer member (8) having at least one mating shoulder (10) having a facing in a direction opposite the setting direction, mating surface cooperating with the stop shoulder (7) of the guide bore (12), wherein the bolt guide (2) has a receiving region (16) provided with an undercut (3), and the buffer member (8) has an end region (13) facing in the setting direction and spaced from the mating shoulder (10), releasably connected with the bolt guide (2), and formed as a radial widening extending into the receiving region (16) of the bolt guide (2) and formlockingly engaging in the undercut (3).

2. A setting tool according to claim 1, wherein the stop shoulder (7) is formed by a widening section of the guide bore (12).

3. A setting tool, according to claim 1, wherein the stop shoulder (7) formed in the guide bore (12) of the piston guide is formed as a ring-shaped shoulder.

4. A setting tool according to claim 1, wherein the mating shoulder (10) of the buffer member (8) is formed by a radial widening of the buffer member (8) extending at least partially over a circumference of the buffer member (8).

5. A setting tool according to claim 4, wherein the mating shoulder (10) is formed by a radially resilient stop ring (15) connected with the buffer member (8) and forming a portion of the radial widening of the buffer member (8), the stop ring (15) being formed of a material having a greater rigidity than a material the buffer member (8) is formed of.

6. A setting tool according to claim 1, wherein first and second sealing rings (9, 11) are provided on opposite end surfaces of the buffer member (8), respectively.

7. A setting tool according to claim 6, wherein the first sealing ring (9) is provided in a radially outer region of the end surface of the buffer member facing in the direction opposite the setting direction.

8. A setting tool according to claim 6, wherein the second sealing ring (11) is provided in a radially inner region of the end surface of the buffer member facing in the setting direction.

* * * * *